US005313222A

United States Patent [19]

Lee

[11] Patent Number: 5,313,222

[45] Date of Patent: May 17, 1994

[54] SELECT DRIVER CIRCUIT FOR AN LCD DISPLAY

[75] Inventor: Sywe N. Lee, Taipei, Taiwan

[73] Assignee: Yuen Foong Yu H. K. Co., Ltd., Hong Kong

[21] Appl. No.: 996,979

[22] Filed: Dec. 24, 1992

[51] Int. Cl.[5] ..... G09G 3/36

[52] U.S. Cl. ..... 345/58; 345/99; 345/100; 345/197

[58] Field of Search ..... 340/784, 800; 345/87, 345/197, 58, 99, 100

[56] References Cited

U.S. PATENT DOCUMENTS

| | | | |
|---|---|---|---|
| 3,938,135 | 2/1976 | DeJule | 340/800 |
| 4,231,035 | 10/1980 | van Doorn et al. | 340/784 |
| 4,233,603 | 11/1980 | Castleberry | 340/784 |
| 4,403,217 | 9/1983 | Becker et al. | 340/718 |
| 4,412,214 | 10/1983 | Tanaka | 340/784 |
| 4,701,799 | 10/1987 | Yoshimura | 340/784 |
| 4,836,656 | 6/1989 | Mouri | 340/784 |
| 4,922,240 | 5/1990 | Duwaer | 340/784 |
| 4,931,787 | 6/1990 | Shannon | 340/784 |
| 5,034,735 | 7/1991 | Inoue | 340/784 |
| 5,113,181 | 5/1992 | Inoue et al. | 340/783 |
| 5,151,689 | 9/1992 | Kabuto et al. | 340/784 |
| 5,151,805 | 9/1992 | Takeda et al. | 359/57 |
| 5,157,386 | 10/1992 | Uchida | 340/784 |
| 5,159,325 | 10/1992 | Kuijk et al. | 340/783 |

*Primary Examiner*—Alvin E. Oberley
*Assistant Examiner*—Minsun Oh
*Attorney, Agent, or Firm*—Jones, Day, Reavis & Pogue

[57] ABSTRACT

A circuit for use with an LCD display wherein the LCD display contains a first number of pixel columns and a second number of pixel rows on a substrate is provided. The circuit comprises a plurality of row select driver circuits corresponding to the number of pixel rows for electrically energizing the pixel rows. The row select driver circuit is deposited on the LCD display substrate and an output of each of the row select driver circuits is electrically connected to a corresponding pixel row and to a successive row select driver circuit as an activating input. Switching apparatus external to the LCD display and having leads electrically connected to the row select driver circuits is also provided for electrically switching the row select driver circuits such that each pixel row is sequentially energized. A corresponding method is also disclosed.

14 Claims, 5 Drawing Sheets

SELECT DRIVER CIRCUIT FOR AN LCD DISPLAY

BACKGROUND OF THE INVENTION

1. Field of the Invention

The present invention relates to a circuit for selectively driving pixel rows in an LCD display and more particularly to a row select driver circuit using thin-film transistors deposited on a substrate of the liquid crystal display.

2. Description of the Related Art

Displays using liquid crystal display (LCD) or similar devices include thin-film MOS transistors deposited on a glass substrate. At present, almost all commercially available active matrix liquid crystal displays (AMLCD) are unscanned.

An unscanned AMLCD requires one external lead for each column and row line. For example, a direct line interface driver for a black and white 768×1024 XGA computer display would require 1792 leads. The need for this great number of leads in the display drivers is a major problem which gets worse as the resolution and complexity of displays increase. Two major goals for solving the problem are to reduce the number of required input leads and to "integrate" the driver circuitry such as shift registers and latches directly onto the display substrate.

U.S. Pat. No. 5,034,735 discloses a driving apparatus using two transistors per pixel row for producing select and deselect signals and sequentially addressing them through the transistors' control gates. These transistors may be formed as thin-film transistors on a glass substrate along with a switching circuit 43, a switching signal generating unit 41, a scanning selection signal bus 411, and a scanning nonselection bus 412.

U.S. Pat. No. 5,157,386 discloses a circuit driving an active matrix liquid crystal display having M rows and N columns by video digital data of K bits. An analog switch capable of ON and OFF states receives a video voltage and a control signal and selectively outputs the video voltage to each column in response to a control signal. This is not a circuit for selectively driving the rows of a display.

U.S. Pat. No. 5,113,181 discloses a display apparatus comprising a plurality of pixels arranged in rows and columns. A data driver demultiplexer is disclosed.

The above-cited U.S. Pat. are the best known examples of relevant prior art known to the inventor. Almost all of the other commercially available active matrix liquid crystal displays are unscanned.

SUMMARY OF THE INVENTION

The present invention solves the above-stated problems through the use of an integrated row select driver circuit. The function of the novel row select driver circuit is similar to a shift register.

A circuit for use with an LCD display is provided wherein the LCD display has a first plurality of pixel columns and a second plurality of pixel rows all deposited on a substrate such as glass. The circuit includes a plurality of row select driver circuits corresponding to the number of pixel rows which electrically energize the pixel rows. The row select driver circuits are deposited on the glass substrate with the pixel columns and rows. An output of each of the row select driver circuits is connected to a corresponding pixel row line and to a successive row select driver circuit as an activating input. Switching apparatus external to the LCD display has leads electrically connected to the row select driver circuits wherein the number of leads is far less than the number of pixel rows. In one example, the number of leads is reduced from 240 to 10.

It is therefore an object of the present invention to reduce manufacturing costs and increase performance reliability by eliminating the need for mounting integrated circuits on a separate substrate.

It is a further object of the present invention to produce a new select driver circuit driving scheme which can be integrated directly onto the display substrate. This eliminates the cost of peripheral ICs and the hybrid assembly needed by unscanned AMLCDs.

BRIEF DESCRIPTION OF THE DRAWINGS

These and other objects of the present invention will be more clearly understood in connection with the accompanying detailed description of the attached drawings in which.

DESCRIPTION OF THE PREFERRED EMBODIMENT

Figure 1:
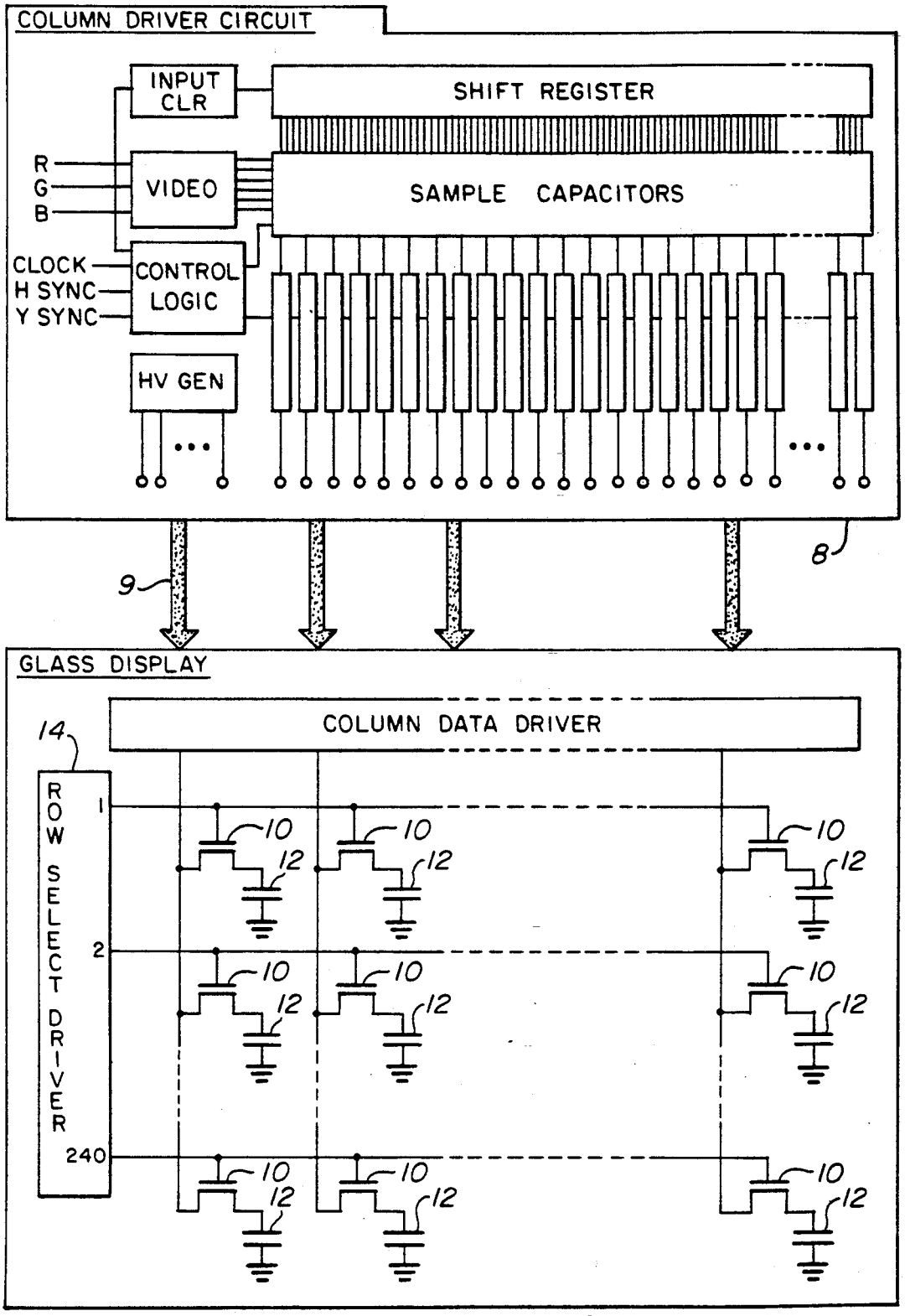
FIG. 1 is a block diagram of a circuit in which the row select driver circuit of the present invention may be used.
Figure 2:
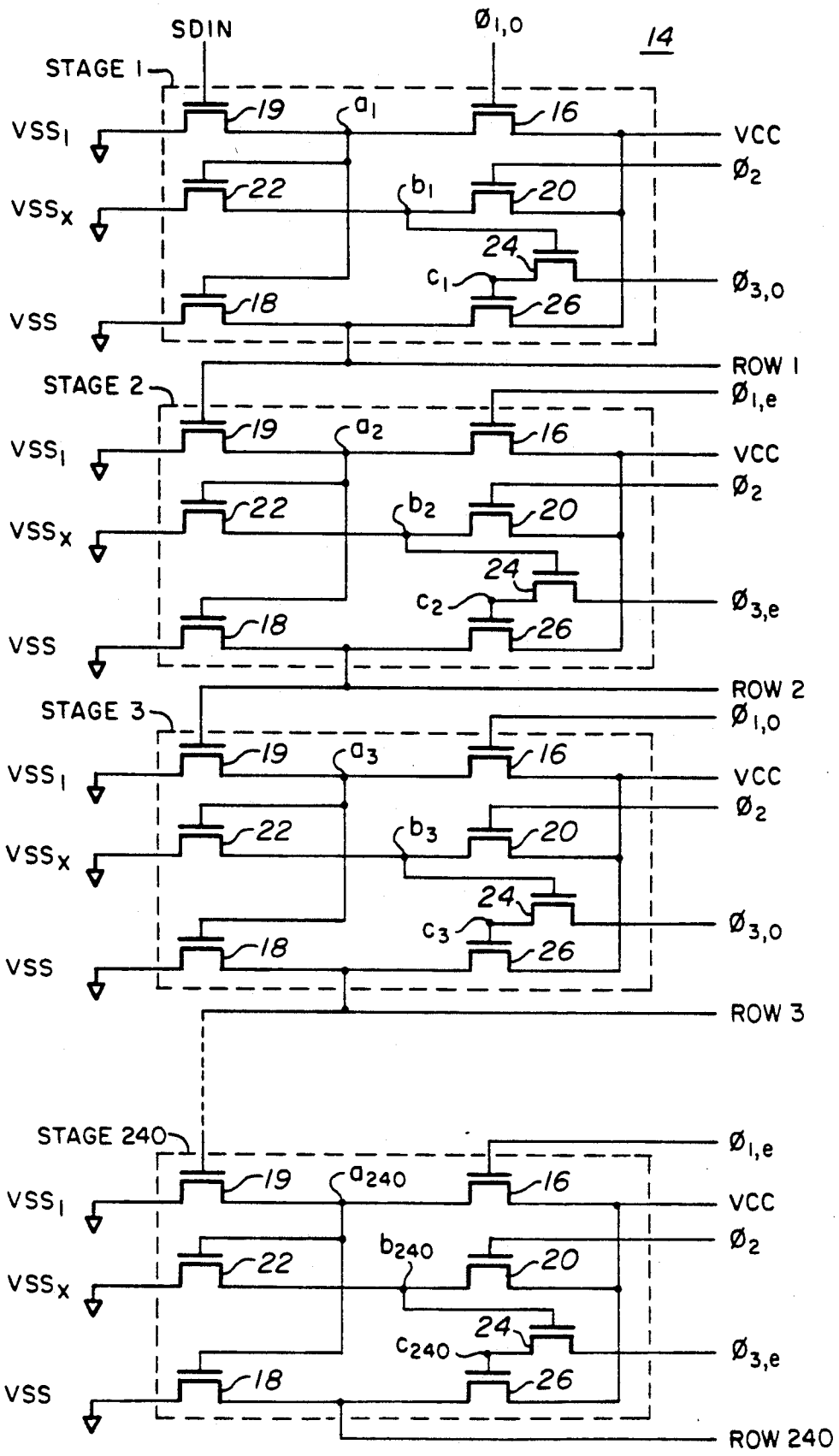
FIG. 2 is a schematic diagram in accordance with the present invention.

The present invention will be described with the use of a 384×240 pixel color hand-held portable TV as an example only. The circuit diagram of FIG. 1 is disclosed in detail in commonly assigned copending application Ser. No. 971,721 filed Nov. 3, 1992 entitled DATA DRIVING CIRCUIT FOR LCD DISPLAY which is incorporated herein in its entirety by reference. Block 14, labeled row select driver, represents the present invention and is shown coupled only to the first two rows and the last row of pixel transistors 10 and capacitors 12. The row select driver circuit 14 is coupled to a switching device or control logic in OFF display control circuit 8 as explained in the above-noted copending application. Leads 9 couple the switching device or control logic to the row select driver circuit 14 on the display The details of the row select driver circuit of the present invention are shown in FIG. 2.

It is noted that row select driver circuit 14, though shown only on one side of the glass display in FIG. 1, could also include a second identical row select driver circuit connected to the pixel row lines on the opposite side of the glass display. This second row select driver circuit would provide circuit redundancy and enhance circuit diagnostics when repairs are necessary.

There are 240 identical circuit stages within row select driver circuit 14. Each circuit stage is indicated by a rectangular dashed line and labeled as stage 1, stage 2, and stage 3 through stage 240. All stages are identical including the stages between stage 3 and stage 240. The row select driver circuit 14 is preferably fabricated with thin-film transistors on the LCD display substrate to generate scanning signals for the display to turn ON and OFF a selected row of pixel transistors 10.

This invention is particularly focused on reducing the number of external lead connections to the row driver circuits to 10 from a number such as 240 in the example used. The circuit solves the problem using amor phous silicon thin-film transistors which have poor device performance characteristics such as low mobility, nonuniform threshold voltages, and threshold voltage shifting and that can be deposited directly on the glass substrate.

As shown in FIG. 2, the row select driver circuit 14 is divided into odd and even stages. Each stage preferably consists of 7 transistors. The output of stage 1 is connected to the input of stage 2 and to the first row line of pixel transistors 10. The output of stage 2 is connected to the input of stage 3 and to the second row line of pixels and so forth through stage 240. All stages receive a common or first clock signal $\Phi_2$, all odd stages receive second and fourth clock control signals $\Phi_{1,o}$ and $\Phi_{3,o}$, respectively, all even stages receive third and fifth clock control signals $\Phi_{1,e}$ and $\Phi_{3,e}$, respectively. All stages are connected to a common power supply VCC, a common ground VSS, and common psuedo-grounds $VSS_x$ and $VSS_1$. A sixth or SDIN shift-in clock signal is connected to the first stage of the select driver circuit 14. Thus, the input leads 9 from the switching device or control logic in control circuit 8 comprises SDIN, $\Phi_{1,o}$, $\Phi_{1,e}$, $\Phi_2$, $\Phi_{3,o}$, $\Phi_{3,e}$, VCC, VSS, $VSS_x$ and $VSS_1$. It can be seen that only 10 control leads are needed to control 240 row select driver circuits as will be explained hereafter.

Figure 3:
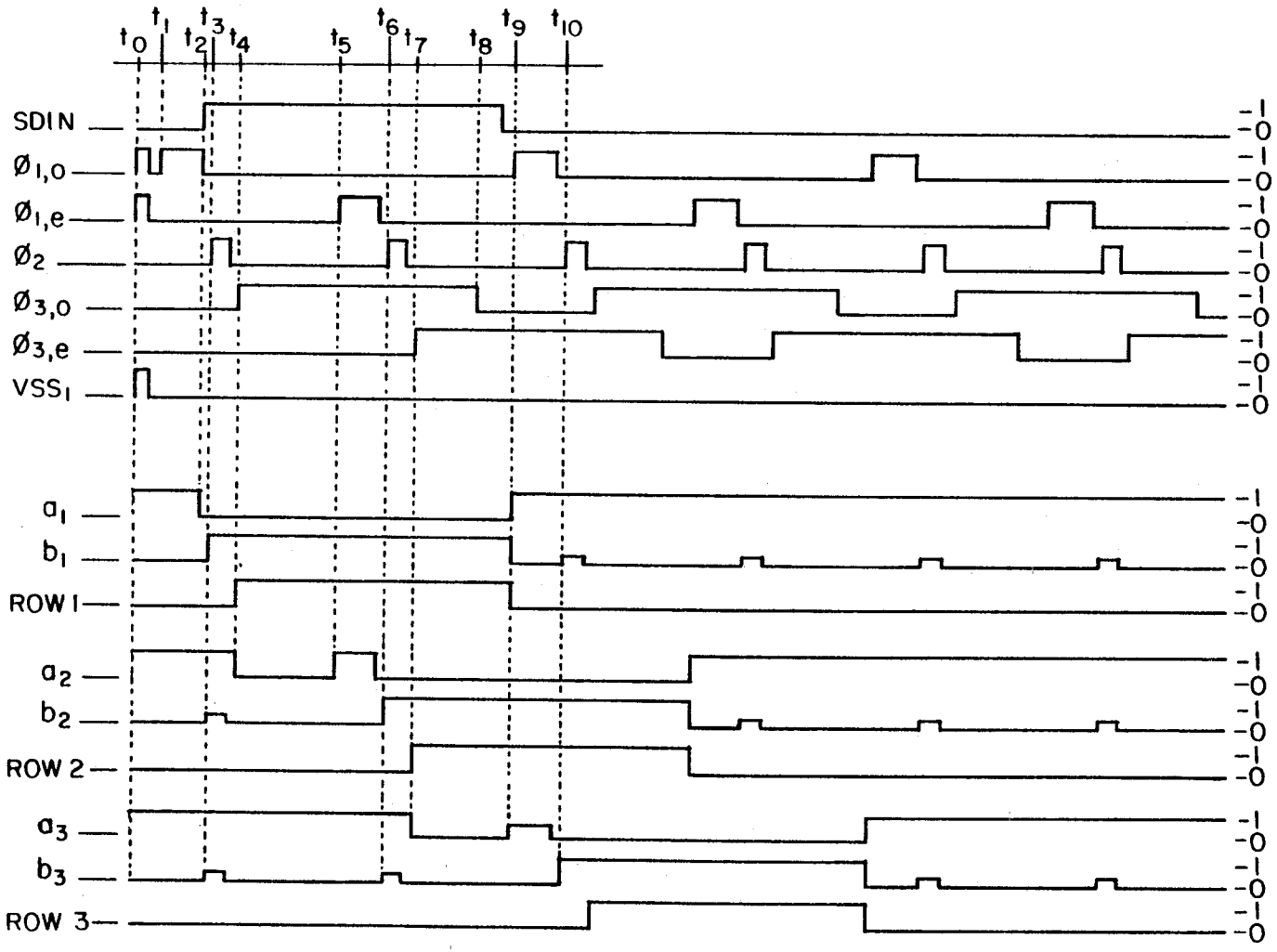
FIG. 3 is a timing diagram of the inputs and outputs to the circuits of FIG. 2.

The waveforms of the controlling clock signals are shown in FIG. 3. The period of the clock signal $\Phi_2$, i.e. the time from the beginning of one pulse, $\Phi_2$, to the beginning of the next $\Phi_2$ pulse, is the same, for this example, as a TV scanning line time which, using the NTSC system, is approximately 63 microseconds. The other clock signals, namely $\Phi_{1,o}$, $\Phi_{3,o}$, $\Phi_{1,e}$, and $\Phi_{3,e}$, have a period which is twice as long as that of $\Phi_2$. The output of each stage, row 1, row 2, row 3, ... row 240, is connected to a row of the display's pixel gate line as shown in FIG. 1.

Video information is supplied to the system of FIG. 1 one-row-at-a-time. As those skilled in the art are aware, the low mobility of thin-film resistors of FIG. 2 make it likely that the system of FIG. I will fall short on row-select time during one line period, 63 $\mu$s in this example. Therefore, in order to achieve a longer row-select time to charge or discharge the pixel capacitors 12, a successive row is actually activated before the previous row is deactivated. However, only one line of information i.e. pixel row, is locked in at any given line-time period. This operation is termed "line preselection". The advantage of this new row-select driver circuitry disclosed herein is to reduce the number of external lead connections. In this example, the number of lead connections is reduced from 240 to 10. This lead reduction in turn significantly simplifies the LCD assembly and packaging by greatly reducing the number of external lead connections. Although the novel circuitry requires seven transistors per stage, the transistors are, of course, extremely small and are easy to fabricate on the glass substrate. As a result, this new row select driver circuitry reduces manufacturing costs because of the significant reduction of lead connections to the glass substrate.

As shown in FIG. 2 and the timing diagram of FIG. 3, at the beginning of the operation the $\Phi_{1,o}$ and $\Phi_{1,e}$ clock lines issue initialization pulses at time $t_0$. $\Phi_{1,o}$ and $\Phi_{1,e}$ have the initialization clock impulses that turn ON transistor 16 in all stages thereby causing all nodes a1, a2, ... $a_{240}$ to be charged to a voltage level of approximately $VCC-V_t$ (logical "1"), where $V_t$ is the threshold voltage of transistor 16. At this point all nodes $a_1$ through $a_{240}$ cause all transistors 18 in all stages to conduct which results in all scan lines for rows 1 through 240 to be discharged to the common ground VSS level (logical "0"). It should be noted that the $\Phi_{1,o}$ clock signal occurring at $t_1$ and extending between time $t_1$ and time $t_2$ has no affect on the row select driver circuit 14 because it comes just after an initialization signal pulse and the rows are all at ground level (logical "0").

At time $t_2$, the SDIN signal is pulsed high which turns ON transistor 19 of stage 1 thereby discharging node al of the first stage to $VSS_1$ level, i.e. a logical "0". Then at time $t_3$, $\Phi_2$ is pulsed high (logical "1") to turn ON transistors 20 in all stages which pulls node b1 to a logical "1"level.

Nodes $b_2$ through $b_{240}$ will be at a voltage level near $VSS_x$, because at time $t_3$ only node $a_1$ is at logical "0"level because of the SDIN pulse while nodes $a_2$ through $a_{240}$ remain at logical "1". This causes transistors 20 and 22 in stages 2 through 240 to turn ON, and because transistor 22 is designed to be much larger than transistor 20, preferably 10:1, nodes $b_2$ through $b_{240}$ will be pulled down to a voltage level near $VSS_x$. The size differential between transistors 20 and 22 is significant because the greater physical size of transistor 22 ensures less voltage drop across transistor 22 compared to transistor 20 and therefore ensures more stable operation of the circuit stages, as known by those skilled in the art. After the $\Phi_2$ pulse returns to logical "0", only node $b_1$ remains at logical 1 because node $a_1$ is at logical "0" which turns OFF transistors 22 and 18 in stage 1 but not in any of the other stages.

At time $t_4$, $\Phi_{3,o}$ is raised to the VCC level which causes node $c_1$ to be charged to a logical "1"level because node $b_1$, a logical "1", turned ON transistor 24 in stage 1 only. Once $\Phi_3$ is changed to a logical "1"level, transistor 26 in stage 1 only is turned ON thereby charging row 1 to a logical "1"level. During the period of time at which row 1 is at logical "1", all pixel transistors 10 in row 1 of FIG. 1 are turned ON.

After a time period of 63 $\mu$s from time $t_1$, at time $t_5$, $\Phi_{1,e}$ input lines pulse high thereby turning ON transistor 16 in all even numbered stages and charging nodes $a_2$, $a_4$, $a_6$, ... $a_{240}$ to a logical "1"level. At this time, row 1 is at á logical "1"level which turns on transistor 19 in stage 2 so that node $a_2$ returns to a logical "0"soon after $\Phi_{1,e}$ returns to a logical "0". The $\Phi_2$ input line pulses high at time $t_6$ to turn ON transistors 20 in all stages thereby pulling nodes $b_1$ and $b_2$ to a logical "1", while $b_3$ through $b_{240}$ will be at a voltage near $VSS_x$. At this point nodes $a_1$ and $a_2$ are at a logical "0"and nodes $a_3$ through $a_{240}$ are at a logical "1"so that the internal nodes $b_1$ and $b_2$ remain at logical "1"after $\Phi_2$ returns to logical "0". At time $t_7$, line $\Phi_{3,e}$ is raised to the VCC level and node $c_2$ is thereby charged to a logical "1"because node $b_2$, being at a logical "1", turned ON transistor 24 of stage 2. Then, in turn, node $c_2$ causes transistor 26 of stage 2 to turn ON and charge row 2 to a logical "1", thus causing all the pixel transistors 10 in row 2 to be turned ON.

At time $t_9$, 126 μs after time $t_1$, line $\Phi_{1,o}$ is pulsed high, thus turning ON transistor 16 in all odd number stages except stage 3 and causing all odd nodes $a_1$ through $a_{239}$ to be charged to a logical "1"except node $a_3$. Node $a_3$ will be at an intermediate voltage level between VCC and $VSS_1$. This is because at time $t_9$, both transistors 16 and 19 are turned ON by the $\Phi_{1,o}$ and row 2 signals. Node $a_3$ will return to $VSS_1$ soon after $\Phi_{1,o}$ returns to the logical "0"level. Once node $a_1$ is at a logical "1" level, transistor 18 of stage 1 turns ON, thus discharging row 1 to a logical "0"level, hence row 1 at this point has been deselected.

The control and clock signals during the remaining frame time period will cause the scanning lines row 3 through row 240 to be selected and deselected sequentially in the same manner described above.

It should be noted, as those skilled in the art will appreciate, that in normal operation, the initialization pulses between $t_0$ and $t_1$ are not needed because the first frame of display information is ignored. This is because the first frame of display information is pulsed very quickly and does not adversely affect the display output.

Preferably, power supply VCC in connection with the above description and the pseudo-ground line voltage levels $VSS_1$ and $VSS_x$, and ground line VSS should all be adjusted according to the data driving scheme. Preferably, all ground line voltages are kept separated from each other to reduce noise introduced by the circuit. For example, if a column inversion scheme is used, a VCC of between 15 and 25 volts should be chosen and the ground line voltage levels would then be between a −10 and a −0 volts.

As those skilled in the art will understand, the pulse-width of all the above control and clock signals are determined according to the timing budget of the operation. The size of the thin-film transistor devices should also be optimized to meet the performance requirements.

The operation of the row select driver circuit in accordance with the present invention has been described above in relation to a scanning line time interval of 63 μs for a 380×240 pixel display interfacing to the NTSC TV system. It should be understood that this is only an example of one embodiment of the present invention and other embodiments and timing schemes can be used without departing from the invention hereof. For example, LCD displays other than for TVs or displays with greater resolution could be incorporated within the scope of the present invention.

Given that all the key timing and voltage level control signals are coming from off glass ICs, this circuit provides the convenience and flexibility for optimization of the display system. Also, because of the simplicity of the circuit in operation this circuit should result in a good production yield during manufacture.

Thus the circuit shown in FIGS I and 2 is for use with an LCD display wherein the LCD display contains a first number of pixel columns and a second number of pixel rows on the substrate. The circuit comprises a plurality of row select driver circuits 14, stages 1 through 240, that correspond to the number of pixel rows. They electrically energize the pixel rows. The row select driver circuits are deposited on the LCD display substrate and each generates an output that is electrically connected to a corresponding pixel row and to a successive row select driver circuit as an activating input. The switching means or control logic in control circuit 8 external to the LCD display has leads 9 electrically connected to the row select driver circuits 14 for providing a first clock signal ($\Phi_2$) to all row select driver circuits 14, a second clock signal ($\Phi_{1,o}$) coupled only to all odd numbered row select driver circuits, a third clock signal ($\Phi_{1,e}$) coupled only to even numbered row select driver circuits, a fourth clock signal ($\Phi_{3,o}$) coupled only to all odd row select driver circuits, a fifth clock signal ($\Phi_{3,e}$) coupled only to all even row select driver circuits, and a sixth clock signal (SDIN) coupled to only the first row select driver circuit as a shift signal, the six clock signals causing an output signal from each row select driver circuit such that each pixel row is sequentially energized. It will be seen that the number of external leads 9 from the switching means or control logic in the control circuit 8 is less than the number of pixel rows. Including the ground and the pseudo-grounds, there are only 10 control leads from the switching means to control all 240 row driver circuits as explained previously.

Each of the row select driver circuits includes a plurality of thin-film transistors formed on the glass substrate and interconnected to cause sequential activation of each pixel row.

As explained previously, a first row select driver circuit stage activates a first pixel row for a first predetermined period of time. A second adjacent row select driver circuit stage activates a subsequent pixel row for a second predetermined period of time prior to the termination of the first predetermined period of time such that a longer row select time is provided for each row to charge or discharge the pixels of the corresponding pixel row.

It will also be seen that the output signal from each row select driver circuit not only energizes its corresponding pixel row but it also acts as a shift signal to the succeeding row select driver circuit. Each row select driver circuit includes a first group of interconnected transistors 16 and 18 for receiving one of the second and third clock signals ($\Phi_{1,o}$,$\Phi_{1,e}$) for producing a logical "0"on the corresponding pixel row and a logical "1"at a first internal node, $a_1$, $a_2$ ... $a_{240}$. A second group of interconnected transistors 19, 20 and 22 receives the shift signal, SDIN or a row signal from a preceding row select driver circuit, and the first clock signal, $\Phi_2$, and causes a logical "0"at the selected first internal node a, and a logical "1"at a selected second internal node, b. A third group of interconnected transistors 24 and 26 are connected to the first and second transistor groups for receiving the logical "1" on the second node $b_1$ and one of the fourth and fifth clock signals ($\Phi_{3,o}$, $\Phi_{3,e}$) to produce a logical "1"only at the pixel row corresponding to the row select driver circuit having a logical "0"at the first internal node $a_1$. Since the output of each row select driver circuit to its corresponding row is a logical "0"and that signal also serves as an input to the succeeding stage, only stage 1 has a logical "0"at the first internal node $a_1$ when the shift signal SDIN first appears.

Each succeeding row select driver circuit operates in a similar fashion with the output of the previous stage providing an equivalent "shift" signal similar to the input signal SDIN to the first stage. All of the subsequent stages remain in the OFF condition until they receive the output from the previous stage, at which time the cycle just discussed repeats itself.

The novel circuit enables the first pixel row to be activated for a first predetermined period of time with each successive row select driver circuit activating a corresponding pixel row for a second predetermined period of time prior to the termination of the first predetermined period of time such that a longer row select time is provided for each row to charge or discharge the pixels of the corresponding pixel row. As can be seen in the timing chart of FIG. 3, the $\Phi_2$, $VSS_x$ and $\Phi_{3,o}$ signals are clocked such that the subsequent row is selected while the preceding row is still being energized. Thus although the period between the $\Phi_2$ pulses is 63 μs, the row energization period is twice as long as can be seen in FIG. 3.

The row driving circuit 14 of FIG. 2 can also be viewed as M row driving units on the substrate each producing an output signal. Each output signal is electrically coupled to a corresponding pixel row and to a successive row driving unit. A switching device or control logic in the control unit 8 external to the display provides an initialization clock signal (SDIN) connection to only the first row driving circuit. It also provides common clock signal connections ($\Phi_{1,o}$, $\Phi_{1,e}$, $I_2$, $\Phi_{3,o}$ and $\Phi_{3,e}$) to all the row driving circuits. The output signal of each driving unit 1 through M-1 serves as initialization clock signal to the succeeding driving circuit so that the total number of clock signal connections between the switching device and the display is equal to the common clock signal connections and the initializing clock signal connections to the first row driving circuit.

Thus there has been disclosed a novel row driver circuit for an LCD display that employs thin-film MOS transistors that can be deposited on the glass substrate with the display itself and which reduces the number of input leads, both control and voltage leads, from some predetermined number such as 240 in the example given herein to 10 lines. Thus the advantage of the disclosed driver circuitry is that it reduces the number of external lead connections and significantly solves the thin-film transistor liquid crystal display assembly and packaging problems due to the limitation of the connector pitch.

Further, because the display system gets its video information one-row-at-a-time, and due to the low mobility of the thin-film transistors, the row select time, of 63 μs in the example given herein, may not quite be sufficient. Thus in order to achieve a longer row select time to charge or discharge the pixel capacitor, the present invention selects two-rows-at-a-time but locks in only one line of information at a line time period. This operation is called line preselection.

Figure 5:
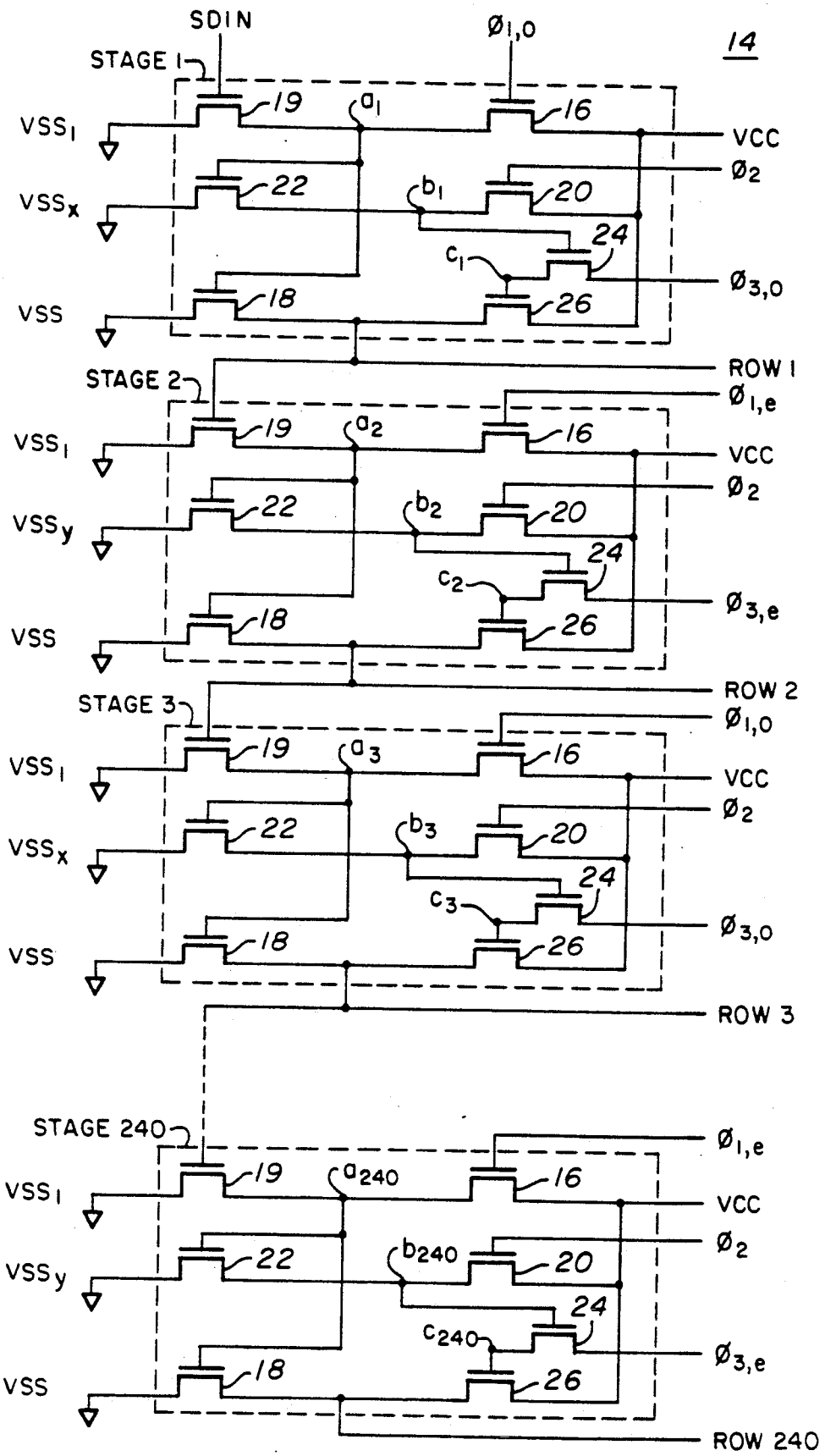
FIG. 5 is a schematic diagram of the alternate embodiment of the invention where $VSS_x$ in all even numbered stages has been replaced with $VSS_y$.

The above-described embodiment is designed for use with normal TFT devices, which have very low current leakage when in an OFF state (approximately 0.1 pico amps per each micron meter of channel width). The circuit of FIG. 2 can be improved to become more leakage current tolerant by modifying the circuit as shown in FIG. 5. However, because after time $t_8$ transistor 24 of stage 1 will be OFF for the rest of the frame, time node $c_1$ may build up enough charge from transistor 24 leaking to cause transistor 26 to conduct some current. This may cause undesired effects such as noise in the row 1 output signal. Similarly, undesired effects may be generated on other row output signals from the build-up of charge on the nodes $c_1$ ... $c_{240}$.

Figure 4:
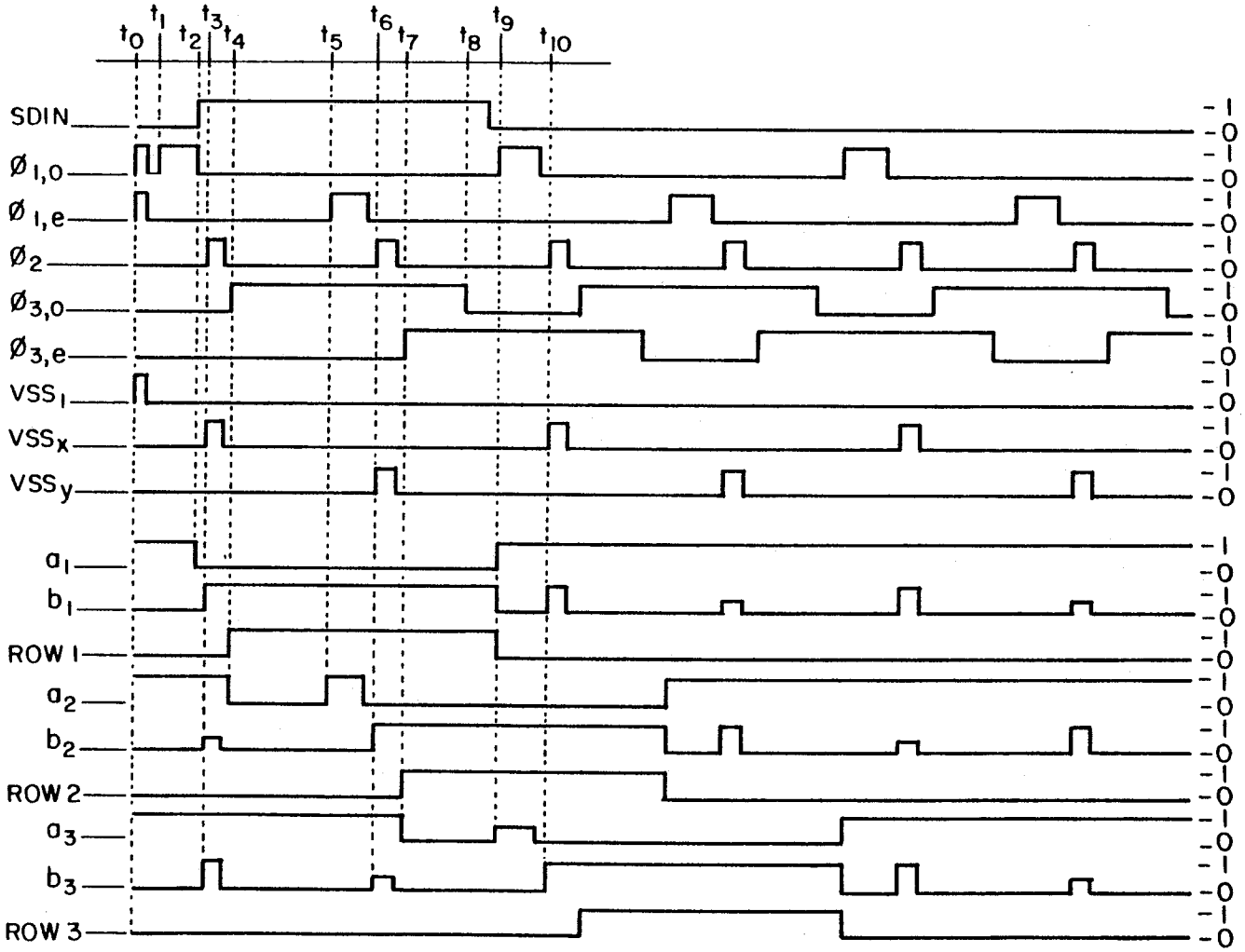
FIG. 4 is an alternate timing diagram of the inputs and outputs to the circuits of FIG. 2 when $VSS_x$ in all even numbered stages is replaced with an additional pseudo-ground, $VSS_y$.

In order to improve the leakage control of internal nodes $c_1$ ... $c_{240}$ and eliminate much of the undesired effects introduced by the charge build-up of nodes $c_1$ ... $c_{240}$, FIG. 2 may be modified by replacing $VSS_x$ with an additional separate pseudo-ground, $VSS_y$, in all even numbered stages as shown in FIG. 5. In addition, the timing diagram of FIG. 4 is used in conjunction with the additional $VSS_y$ pseudo-ground shown in FIG. 5 in order to alternately pulse $VSS_x$ and $VSS_y$ high at every $\Phi_2$ pulse which discharges nodes $c_1$ through $c_{240}$ at every other $\Phi_2$ pulse, i.e. every other line time. In this way nodes c are not allowed to charge to a level which will cause transistors 26 to conduct.

While the invention has been described in connection with a preferred embodiment and an alternate embodiment, it is not intended to limit the scope of the invention to the particular forms set forth, but, on the contrary, it is intended to cover such alternatives, modifications, and equivalents as may be included within the spirit and scope of the invention as defined by the appended claims.

I claim:

1. A circuit for use with a display device wherein said display device contains a first number of pixel columns and a second number of pixel rows on a substrate, said circuit comprising:

a plurality of row select driver circuits (stage 1-240) corresponding to said number of pixel rows for electrically energizing said pixel rows, said row select driver circuits being deposited on the display substrate, wherein an output of each of said row select driver circuits is electrically connected to a corresponding pixel row and to a successive row select driver circuit as an activating input; and switching means external to the display device and having leads electrically connected to said row select driver circuits for providing a first clock signal ($\Phi_2$) to all row select driver circuits, a second clock signal ($\Phi_{1,o}$) coupled only to all odd row select driver circuits, a third clock signal ($\Phi_{1,e}$) coupled only to all even row select driver circuits, a fourth clock signal ($\Phi_{3,o}$) coupled only to all odd row select driver circuits, a fifth clock signal ($\Phi_{3,e}$) coupled only to all even row select driver circuits, and a sixth clock signal coupled to only the first row select driver circuit as a shift signal, the six clock signals causing an output signal from each row select driver circuit such that each pixel row is sequentially energized.

2. The circuit of claim 1 wherein the number of external leads from the switching means is less than the number of pixel rows.

3. The circuit of claim 1 wherein each of said row select driver circuits includes a plurality of thin-film transistors interconnected to cause sequential activation of each pixel row.

4. The circuit of claim 3 further including:

a first row select driver circuit stage activating a first pixel row for a first predetermined period of time; and a second adjacent row select driver circuit stage activating a subsequent pixel row for a second predetermined period of time prior to the termination of said first predetermined period of time such that a longer row select time is provided for each row to charge or discharge the pixels of the corresponding pixel row.

5. The circuit of claim 1 further including:

first pseudo-ground means external to the display device and electrically connected to each of the odd row select driver circuits;

second seudo-ground means external to the display device and electrically connected to each of the even row select driver circuits; and wherein each of the first and second pseudo-ground means is alternately pulsed high at each of the first clock signals for reducing noise generated by the row select driver circuits.

6. The circuit of claim 1 wherein the output signal from each row select driver circuit energizes its corresponding pixel row and acts as a shift signal to the succeeding row select driver circuit.

7. The circuit of claim 6 wherein each row select driver circuit includes:

a first group of interconnected transistors (16, 18) for receiving one of the second and third clock signals ($\Phi_{1,o}$, $\Phi_{1,3}$) for producing a logical "0"on the corresponding pixel row and a logical "1" at a first internal node (al, $a_2$ ... $a_{240}$);

a second group of interconnected transistors (19, 20, 22) for receiving the shift signal (SDIN or row signal) and the first clock signal ($\Phi_2$) and causing a logical "0"at the selected first internal node (a) and a logical "1" at a selected second internal node (b); and a third group of interconnected transistors (24, 26) connected to the first and second transistor groups for receiving the logical "1" on the second node and one of the fourth and fifth clock signals to produce a logical "1" only at the pixel row corresponding to the row select driver circuit having a logical "0"at the first internal node.

8. The circuit of claim 1 wherein the substrate is glass.

9. A circuit as in claim 1 wherein the display device is an LCD display device.

10. A circuit for use with an LCD display wherein said LCD display contains a first number of pixel columns and a second number of pixel rows on a substrate, said circuit comprising:

a plurality of row select driver circuits corresponding to said number of pixel rows for electrically energizing said pixel rows, said row select driver circuits being deposited on the LCD display substrate such that an output of each said row select driver circuit is electrically connected to a corresponding pixel row and to a successive row select driver circuit as an activating input;

said corresponding pixel row being activated by said row select driver circuit for a first predetermined period of time;

each successive row select driver circuit activating a corresponding pixel row for a second predetermined period of time prior to the termination of said first predetermined period of time such that a longer row select time is provided for each row to charge or discharge the pixels of the corresponding pixel row; and switching means external to the LCD display and having a first common clock pulse lead electrically connected to all of said row select driver circuits, second common clock pulse leads electrically connected to all even numbered row select driver circuits, third common clock pulse leads electrically connected to all odd numbered row select driver circuits, and a single input clock pulse lead coupled to only the first row select driver circuit as an initialization signal for electrically switching said row select driver circuits such that each pixel row is sequentially energized with an output signal that acts as an initialization signal to the succeeding row select driver circuit, the total number of said common clock pulse leads and the single input clock pulse lead from said switching means is less than the number of pixel rows.

11. The circuit of claim 9 wherein each row select driver circuit includes:

a first group of connected transistors for receiving the initialization signal and producing a logical "1"at a first internal node and a logical "0"at the corresponding pixel row;

a second group of interconnected transistors connected to said first group for receiving a first clock pulse and the initilization signal for producing a logical "0"at the first internal node and a logical "1"at a second internal node;

a third interconnected transistor group connected to said first and second transistor groups for receiving a second clock pulse and the logical "1" from the second internal node to produce a logical "1" at the pixel row corresponding to said row select driver circuit maintaining said logical "0"at the first internal node.

12. A row driver circuit for a display having N columns and M rows of pixels on a substrate, the row driver circuit comprising:

M row driving units on the substrate each producing an output signal, each output signal being electrically coupled to a corresponding pixel row and to a successive row select driving circuit; and a switching device external to the display for providing an initialization clock signal connection to only the first row driving circuit, and common clock signal connections to all the row driving circuits, the output signal of each driving circuit 1 through M-1 serving as an initialization clock signal to the succeeding driving circuit so that the total number of clock signal connections between the switching device and the display device is equal to the common clock signal connections and the initialization clock signal connection to the first row driving circuit.

13. A method for selectively driving pixel rows in a display device, wherein said display device contains a first number of pixel columns and a second number of pixel rows on a substrate, said method comprising the steps of:

depositing on said substrate a plurality of amorphous silicon row select driver circuits corresponding to said number of pixel rows for electrically energizing said pixel rows;

connecting an output of each of said row select driver circuits to a corresponding pixel row and to a successive row select driver circuit as an activating input;

switching said row select driver circuits by switching means external to the display device and connected to said row select driver circuits by leads such that each pixel row is sequentially energized and the number of said leads from the switching means to the row select driver circuits is less than the number of pixel rows;

energizing a pixel row with a corresponding row select driver circuit for a first predetermined period of time;

energizing a successive pixel row with a successive row select driver circuit corresponding thereto for a second predetermined period of time prior to the termination of said first predetermined period of time thereby providing a longer row select time for each row to charge or discharge the pixels of the corresponding pixel row; and electrically connecting first and second pseudo-ground means external to the display device to each of said row select driver circuits an alternately pulsing said first and second pseudo-ground means to reduce undesired effects generated by the row select driver circuits.

14. A method as in claim 13 wherein the undesired effects include noise.

* * * * *

UNITED STATES PATENT AND TRADEMARK OFFICE

CERTIFICATE OF CORRECTION

PATENT NO. : 5,313,222

DATED : May 17, 1994

INVENTOR(S) : Lee

It is certified that error appears in the above-identified patent and that said Letters Patent is hereby corrected as shown below:

Column 1, line 47, "Pat." should read --patents--.

Column 3, line 6, "amor phous" should read --amorphous--.

Column 3, 53, after "information" and before "i.e.", insert --at-a-time period is provided because only one line,--.

Column 4, line 5, "a1" should read --$a_1$--.

Column 4, line 6, "a2" should read --$a_2$--.

Column 4, line 19, "a1" should read --$a_1$--.

Column 4, line 21, "b1" should read --$b_1$--.

Column 7, line 20 "$I_2$" should read --$\phi_2$--.

Column 8, line 21, delete "(stage 1-240)".

Column 8, line 39, after "signal" and before "coupled", insert --, SDIN,--.

Column 9, line 13, "$\phi_{1,3}$" should read --$\phi_{1,e}$--.

Column 9, line 15, delete "(a1, $a_2$ ...$a_{240}$)".

Column 9, line 17, "shift" should read --shift-in--.

Column 9, line 17, delete "(SDIN or row".

Column 9, line 18, delete "signal)".

UNITED STATES PATENT AND TRADEMARK OFFICE

CERTIFICATE OF CORRECTION

PATENT NO. : 5,313,222
DATED : May 17, 1994
INVENTOR(S) : Lee

It is certified that error appears in the above-indentified patent and that said Letters Patent is hereby corrected as shown below:

Column 9, line 19, "the" should read --a--.

Signed and Sealed this

Third Day of January, 1995

Bruce Lehman

*Attest:*

BRUCE LEHMAN

*Attesting Officer*

*Commissioner of Patents and Trademarks*